US007702260B2

(12) United States Patent
Tanimoto et al.

(10) Patent No.: US 7,702,260 B2
(45) Date of Patent: Apr. 20, 2010

(54) DEVELOPMENT CARTRIDGE, DEVELOPMENT DEVICE, AND IMAGE FORMATION APPARATUS

(75) Inventors: Junichi Tanimoto, Toyokawa (JP); Hiroshi Ibaraki, Okazaki (JP); Shoji Fukui, Hoi-gun (JP); Atsushi Ohata, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 11/331,010

(22) Filed: Jan. 13, 2006

(65) Prior Publication Data

US 2007/0009287 A1 Jan. 11, 2007

(30) Foreign Application Priority Data

Jul. 6, 2005 (JP) ..... 2005-197417

(51) Int. Cl.
*G03G 15/01* (2006.01)

(52) U.S. Cl. ..... 399/227; 399/119; 399/226

(58) Field of Classification Search ..... 399/226, 399/227, 262, 119
See application file for complete search history.

(56) References Cited

U.S. PATENT DOCUMENTS

| | | | | |
|---|---|---|---|---|
| 4,620,783 | A * | 11/1986 | Tanaka et al. | 399/27 |
| 5,956,546 | A * | 9/1999 | Tsuchiya | 399/119 |
| 6,122,469 | A | 9/2000 | Miura et al. | |
| 6,301,460 | B1 * | 10/2001 | Elliott | 399/262 |
| 2003/0165347 | A1 * | 9/2003 | Sawano | 399/227 |
| 2004/0062571 | A1 * | 4/2004 | Moritani | 399/227 |
| 2004/0067075 | A1 * | 4/2004 | Kibune et al. | 399/223 |
| 2004/0184837 | A1 * | 9/2004 | Kinouchi | 399/227 |

FOREIGN PATENT DOCUMENTS

| | | | |
|---|---|---|---|
| CN | 1497376 | | 5/2004 |
| JP | 58-134663 | | 8/1983 |
| JP | 61-151565 | | 7/1986 |
| JP | 02308188 | A * | 12/1990 |
| JP | 5-307309 | | 11/1993 |
| JP | 6-148968 | | 5/1994 |
| JP | 7-199586 | | 8/1995 |
| JP | 11-316479 | | 11/1999 |
| JP | 2000-128348 | | 5/2000 |
| JP | 2001-83800 | A | 3/2001 |
| JP | 2003-307903 | | 10/2003 |
| JP | 2004-109438 | | 4/2004 |
| JP | 2005-133313 | | 5/2005 |

OTHER PUBLICATIONS

Notification of Reasons for Refusal issued in corresponding Japanese Patent Application No. 2005-197417, and translation thereof.
Notification of Reasons for Refusal issued on Sep. 30, 2008 in corresponding Japanese Patent Application No. 2005-197417, and translation thereof.
First Notification of Reasons for Refusal issued in corresponding Chinese Patent Application No. 2006100047662, and translation thereof.

* cited by examiner

*Primary Examiner*—David P Porta
*Assistant Examiner*—Bryan P Ready
(74) *Attorney, Agent, or Firm*—Buchanan Ingersoll & Rooney PC

(57) ABSTRACT

There is provided a development cartridge capable of switching development colors in a plurality of development cartridges without using development rack. A development cartridge of the present invention has a part of a drive member for switching development colors.

15 Claims, 5 Drawing Sheets

DEVELOPMENT CARTRIDGE, DEVELOPMENT DEVICE, AND IMAGE FORMATION APPARATUS

RELATED APPLICATION

This application is based on Japanese Patent Application No. 2005-197417 filed in Japan on Jul. 6, 2005, the content of which is incorporated herein by reference.

BACKGROUND OF THE INVENTION

The present invention relates to a development cartridge, a development device and an image formation apparatus.

As one of electrophotography-type image formation apparatuses, a four-cycle color image formation apparatus has conventionally been known. The color image formation apparatus of this type forms color images by forming four color toner images on a photoreceptor by four development cartridges corresponding to four color toners: yellow; magenta; cyan; and black, and sequentially superimposing these four color toner images on an intermediate transfer belt.

In the conventional four-cycle color image formation apparatus, as disclosed in JP 2001-83800 A shown below, the four development cartridges are generally loaded side by side in circumferential direction in a rotatable development rack. Normally, as shown in FIGS. 7 and 8, a development rack 60 is structured such that its peripheral region is divided into four sections by four blade-like members 64 provided radially around a rotation shaft 62 in a standing posture, and four development cartridges 66 are loaded in respective divided regions. Moreover, in both end portions, of the development rack 60 with each development cartridge 66 loaded therein, disc-shaped retention members 68, 70 for retaining each development cartridge are secured. The retention member 70 has an all-around gear formed in its peripheral portion, and the all-around gear is engaged with a drive gear 72. Consequently, the drive gear 72 transmits drive force to the retention member 70, by which the development rack 60 is rotationally driven.

However, the development rack 60 is heavy as four development cartridges 66 filled with toners of respective colors are loaded therein, and this incurs a possibility that torsion is generated due to transmission of rotational drive force from one end portion. Such torsion may cause parallelism between a development roller of a development cartridge at a development position and a photoreceptor off-balanced. Accordingly, in order to prevent the torsion from being generated, the development rack 60 requires properly high rigidity, and this has prevented reduction in size and weight of the development rack 60.

Moreover, on the lateral surface of the retention member 70, four plate-like development position detection pieces 74 are provided in a standing posture at 90 degrees intervals in circumferential direction. By detecting the plate-like development position detection pieces 74 by a sensor such as photointerrupters mounted on the image formation apparatus itself, each development cartridge can be stopped at a development position (referring hereinbelow to the position where the development roller is in contact with the photoreceptor). However, since the retention member 70 is a large member made of resin, it is difficult to secure component accuracy, and even when the development rack 60 is stopped at the position where the plate-like development position detection pieces 74 are detected, sometimes the position accuracy between the photoreceptor and the development roller cannot be secured. Accordingly, in order to secure the position accuracy, the loading positions of the development cartridges 66 need fine adjustment performed in the state that the development cartridges 66, the development rack 60 and the retention members 68, 70 are assembled, and this operation is time-consuming.

Further, in the case of doing maintenance of a certain component around the development rack in the image formation apparatus, the development rack 60 still remains in the apparatus after all the development cartridges 66 are unloaded, making the maintenance operation difficult to perform.

SUMMARY OF THE INVENTION

An object of the present invention is to provide a development cartridge, a development device and a color image formation apparatus using the same, which can achieve reduction in number of components, size and cost by removing development rack and retention members from a four-cycle color image formation apparatus.

In order to accomplish the object, a development cartridge of the present invention has a part of a drive, member for switching development colors.

According to the structure, drive force is transmitted through a part of the drive member to the development cartridge, so that the development cartridge can be moved to a development position. This makes it possible to eliminate the use of conventional development rack and retention members also including function as the members for rotationally driving the development rack, thereby achieving reduction in number of components, size and cost of the image formation apparatus. Moreover, the absence of the development rack in the image formation apparatus enhances the maintenance inside the apparatus.

The development cartridge of the present invention may further includes a development position detection section.

According to this structure, by detecting the development position detection section by a sensor such as photointerrupters, it can be accurately detected that the development cartridge reaches the development position.

The development cartridge of the present invention may further include a connection section for establishing direction connection to other development cartridges.

According to this structure, the development device can be constituted of the development cartridges which are connected to each other without special members interposed therebetween, which eliminates the use of the conventional development rack and retention members.

The development cartridge of the present invention may further include a part of a rotation spindle.

According to this structure, when the development device is constituted by connecting a plurality of development cartridges, a part of the rotation spindles are combined to constitute a column-shaped rotation spindle, which eliminates the necessity of additional provision of a rotation spindle for the development device.

In the development cartridge of the present invention, a part of the drive member may be integrated with the development cartridge.

According to this structure, forming a part of the drive member with the development cartridge by, for example, the integral molding can save the trouble of assembly and facilitates manufacturing.

In the development cartridge of the present invention, a part of the drive member may be provided respectively on both end sides in longitudinal direction of the development cartridge.

According to this structure, drive force is transmitted to the development cartridge in a balanced manner through a part of the drive members on both the ends, which prevents torsion to be generated in the development cartridge by the drive force.

Further in the development cartridge of the present invention, the drive member may be a series of gears.

According to this structure, a gear provided on the development cartridge is engaged with a drive gear to transmit drive force, so that the development cartridge can be moved.

There is provided in the present invention a color image formation apparatus including a development cartridge having a part of a drive member for switching development colors, wherein the development cartridge at a development position where a development roller is in contact with a photoreceptor is driven through a part of the drive member.

According to this structure, drive force is transmitted to a development cartridge at a development position through a part of the drive member to drive the development cartridge, so that the development cartridge can be moved to the development position at high accuracy. This makes it possible to eliminate the use of conventional development rack and retention members also including function as the members for rotationally driving the development rack, thereby achieving reduction in number of components, size and cost of the image formation apparatus. Moreover, the absence of the development rack in the image formation apparatus enhances the maintenance inside the apparatus.

In the color image formation apparatus of the present invention, the development cartridge may further include a development position detection section, and it may be detected by the development position detection section of the development cartridge at a development position that the development cartridge is at the development position where a development roller is in contact with a photoreceptor.

According to this structure, by detecting the development position detection section by a sensor such as photointerrupters, it can be accurately detected that the development cartridge reaches the development position.

In the color image formation apparatus of the present invention, the development cartridge may further include a part of a rotation spindle, and a position of the development position detection section may be detected on a straight line connecting a rotation center of the photoreceptor and a center of the rotation spindle.

According to this structure, the position detection of the development cartridge is performed on the straight line connecting the rotation center of the photoreceptor and the center of the rotation spindle, which allows the development cartridge to be aligned with the photoreceptor at high accuracy.

In the color image formation apparatus of the present invention, the development cartridge may further include a connection section for establishing direct connection with other development cartridges, and a plurality of development cartridges may be connected through the connection sections so that the a part of the drive members are combined to constitute a series of gears.

According to this structure, the development device can be constituted of the development cartridges which are directly connected to each other without special members interposed therebetween, which eliminates the use of the conventional development rack and retention members. Moreover, a part of the drive members are combined to constitute a series of gears so that a series of the gears is engaged with a drive gear to transmit drive force, and therefore a plurality of the development cartridges connected to each other can be moved.

Further, in the color image formation apparatus of the present invention, the development cartridge may further include a part of a rotation spindle, and a plurality of the development cartridges may be connected through the connection sections so that a part of the rotation spindles are combined to form a column shape.

According to this structure, when the development device is constituted by connecting a plurality of development cartridges, a part of the rotation spindles are combined to constitute a column-shaped rotation spindle, which eliminates the necessity of additional provision of a rotation spindle for the development device.

There is also provided in the present invention a development device including a plurality of development cartridges each having a connection section, the development cartridges being integrated by direction connection through the connection sections.

According to this structure, the development device is constituted by integrating a plurality of development cartridges through direct connection via the connection sections, which eliminates the use of conventional development rack for loading a plurality of development cartridges. This makes it possible to reduce number of components, size and cost of the image formation apparatus.

In the development device of the present invention, a plurality of the development cartridges integrated by direction connection through the connection sections may form an almost column shape.

According to this structure, the development device constituted by integrating a plurality of development cartridges through direct connection via the connection sections forms an almost column shape, so that rotational drive of the development device can move a specified development cartridge to a development position.

In the development device of the present invention, a plurality of the development cartridges may each include a part of a drive member for switching development colors, and a plurality of the development cartridges may be integrated by direct connection through the connection sections so that a part of the drive members are combined to constitute a series of gears.

According to this structure, the development device can be constituted of the development cartridges which are connected to each other without special members interposed therebetween, which eliminates the use of the conventional development rack and retention members. Moreover, a part of the drive members are combined to constitute a series of gears so that a series of the gears is engaged with a drive gear to transmit drive force, and therefore a plurality of the development cartridges connected to each other can be moved.

In the development device of the present invention, a series of the gears that is the drive member may be disposed respectively on both ends in longitudinal direction of the development device.

According to this structure, drive force is transmitted to the development cartridge in a balanced manner through a series of the gears on both the ends, which prevents torsion to be generated in the development cartridge by the drive force.

The development device of the present invention may be driven via a part of the drive member of the development cartridge positioned at a development position facing a photoreceptor.

According to this structure, even when the development device constituted by connecting a plurality of the development cartridges has loose linkage parts, driving the development device through a part of the drive member of the development cartridge at the development position facing the photoreceptor allows a specified development cartridge to be moved to the development position at high accuracy without being affected by the loose linkage parts.

In the development device of the present invention, the development cartridge may further include a part of a rotational spindle, and a plurality of the development cartridges may be connected and integrated so that a part of the rotation spindles are combined to form a column shape.

According to the structure, in the development device constituted by connecting a plurality of development cartridges, a part of the rotation spindles are combined to constitute a column-shaped rotation spindle, which eliminates the necessity of additional provision of a rotation spindle for the development device.

In the development device of the present invention, a plurality of the development cartridges may each have a development position detection section, and it may be detected by the development position detection section of the development cartridge at a development position that a specified development cartridge is at the development position facing a photoreceptor.

According to this structure, by detecting the development position detection section by a sensor such as photointerrupters, it can be accurately detected that a specified development cartridge reaches the development position.

As described above, according to the development cartridge, the development device and the image formation apparatus in the present invention, drive force is transmitted through a part of the drive member provided on the development cartridge so as to allow the development cartridge to be moved for switching development colors, which makes it possible to eliminate the use of conventional development rack and retention members also including function as the members for rotationally driving the development rack, thereby achieving reduction in number of components, size and cost of the image formation apparatus. Moreover, the absence of the development rack in the image formation apparatus enhances the maintenance inside the apparatus.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
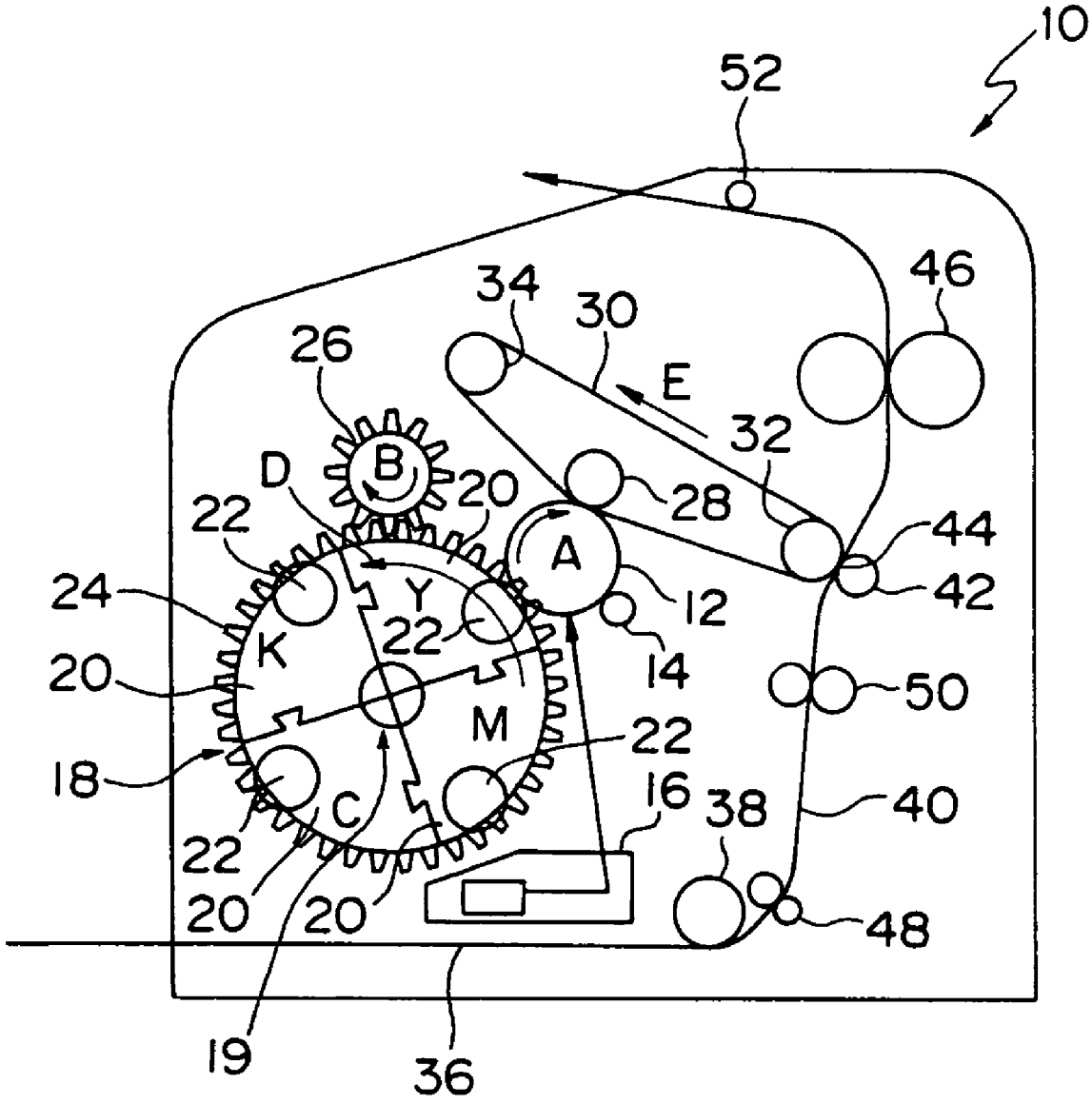
FIG. 1 is an overall structural view showing a color image formation apparatus.

FIG. 1 shows an outlined structure of a color image formation apparatus 10 in one embodiment of the present invention. The color image formation apparatus 10 has, for example, a dram-type photoreceptor 12 rotationally driven in an arrow A direction. The surface of the photoreceptor 12 is uniformly charged by an electrifier 14 and then the uniformly charged surface is exposed to laser light by an exposure unit 16 so as to form an electrostatic latent image.

An almost column-shaped development device 18 is disposed adjacent to the photoreceptor 12. The development device 18 is supported rotatably around a column-shaped rotation spindle 19 disposed in a protruding manner from both end faces in longitudinal direction (i.e., vertical to the surface of the drawing sheet). The development device 18 is constituted of four development cartridges 20 respectively containing four color toners: yellow (Y); magenta (M); cyan (C); and black (K). Each development cartridge 20 has a development roller 22. The development roller 22 is for transporting the toner contained in the development cartridge 20 by rotational drive so as to feed the toner for development of an electrostatic latent image on the surface of the photoreceptor 12.

On a peripheral section in a longitudinal direction end section of the development device 18, a series of gears (drive member) 24 is provided all around its periphery. The gears 24 are engaged with a drive gear 26. Consequently, with the drive gear 26 being rotationally driven in an arrow B direction, the development device 18 is rotated in an arrow D direction.

An intermediate transfer belt 30 is in tight contact with the photoreceptor 12 by a primary transfer roller 28. The intermediate transfer belt 30, which forms an endless sheet made of, for example, a resin film, is supported in the state of being pulled from the inside by a specified tension by a drive roller 32, a driven roller 34 and the primary transfer roller 28 and is rotationally driven by the drive roller 32 in an arrow E direction.

A portion of the intermediate transfer belt 30 supported by the drive roller 32 is in tight contact with a secondary transfer roller 42. A contact portion between the intermediate transfer belt 30 and the secondary transfer roller 42 constitutes a secondary transfer section 44. Above the secondary transfer section 44, a fixation unit 46 made of a pair of rollers is provided.

In a lower portion of the color image formation apparatus 10, a paper feed section 36 is provided. Paper sheets piled and stored in the paper feed section 36 are sent out one by one from the uppermost paper sheet to a paper transportation line 40 by a paper feed roller 38. The paper transportation line 40 extends from the paper feed roller 38 through a pair of transportation rollers 48, a pair of timing rollers 50, the secondary transfer section 44 and the fixation unit 46 to a paper discharge roller 52.

In the thus-structured color image formation apparatus 10, upon input of a print signal containing image data from the outside, the photoreceptor 12 is rotationally driven so that the surface of the rotating photoreceptor 12 is uniformly charged by the electrifier 14. The surface of the uniformly charged photoreceptor 12 is exposed to laser light corresponding to the image data by the exposure unit 16 so as to form an electrostatic latent image. The electrostatic latent image is developed by, for example, a yellow (Y) development cartridge 20 which is positioned at a development position (i.e., at the position of the development cartridge 20 whose development roller 22 is in contact with the photoreceptor 12) to make a yellow toner image. The yellow toner image is moved with rotation of the photoreceptor 12, and is primary-transferred onto the intermediate transfer belt 30 by electrostatic force of the primary transfer roller 28 to which transfer bias is applied.

Then, rotational drive of the drive gear 26 in the arrow B direction rotates the development device 18 in the arrow D direction, and when a magenta (M) development cartridge 20 is moved to the development position, the rotation of the development device 18 is stopped. It is to be noted that a method for detecting that a specified development cartridge 20 reaches the development position will be described later.

At this point, a magenta electrostatic latent image is formed on the surface of the photoreceptor 12, and the electrostatic latent image is developed by the magenta (M) development cartridge 20 which has reached the development position to make a magenta toner image. By electrostatic force of the primary transfer roller 28, the magenta toner image is primary-transferred on top of the yellow toner image on the intermediate transfer belt 30 which has rotated one time. It is to be noted that when the intermediate transfer belt 30 rotates one time while carrying a toner image, the secondary transfer roller 42 is held in the state of being away from the intermediate transfer belt 30.

Hereinafter in the same process, a cyan toner image and a black toner image are seriatim primary-transferred on top of the former two color toner images on the intermediate transfer belt 30. The resultant four color toner images formed in the state of being superimposed on the intermediate transfer belt 30 are moved to the secondary transfer section 44 with the rotation of the intermediate transfer belt 30. At this point, the secondary transfer roller 42 is returned to the state of being in tight contact with the intermediate transfer belt 30, and by electrostatic force of the secondary transfer roller 42 to which transfer bias is applied, the four color toner images are secondary-transferred collectively from the intermediate transfer belt 30 onto a paper sheet which is sent away from the paper feed section 36 and is led into the secondary transfer section 44 by the pair of timing rollers 50.

After the toner images on the paper sheet are fixed by heating when the paper sheet passes through the fixation unit 46, the paper sheet is discharged out of the apparatus by the paper discharge roller 52.

Now, the development device 18 is described in detail.

As described before, the development device 18 is constituted of four development cartridges 20, and since all development cartridges 20 of respective color toners have the same structure, description is herein given of the yellow toner development cartridge 20 as an example.

Figure 2:
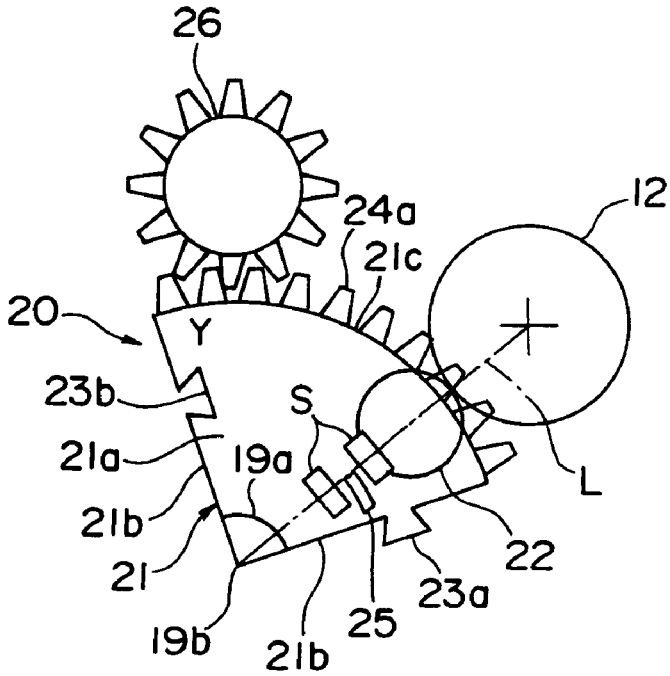
FIG. 2 is an enlarged view showing a development cartridge at a development position.

FIG. 2 shows the yellow toner development cartridge 20 at the development position. The development cartridge 20 has a housing 21 made of, for example, resin for housing the toner. The housing 21 is formed from both end faces 21*a* in longitudinal direction (i.e., vertical direction to the surface of the drawing sheet) each in a fan shape having a 90-degree vertex angle, two plane lateral faces 21*b* extending in longitudinal direction so as to form the vertex angle, and a face 21*c* extending in longitudinal direction so as to connect the top end portions of two lateral faces 21*b* and curved in a circular arc shape.

On the peripheral face 21*c* of the housing 21, an elongated rectangular aperture extending along the longitudinal direction is formed, and the development roller 22 is disposed in the state of being exposed to the aperture so as to slightly protrude outward from the aperture. In the case where the development cartridge 20 is positioned at the development position, its development roller 22 protruding from the aperture comes into contact with the photoreceptor 12.

On the peripheral face 21*c* in the vicinity of one end face 21*a*, a segment gear 24*a*, which constitutes a series of gears 24 when four development cartridges 20 are connected and combined, is formed integrally with the peripheral face 21*c*, and the segment gear 24*a* is engaged with the drive gear 26.

On one lateral face 21*b* of the housing 21, a connection protruding section (connection section) 23*a* having a trapezoid lateral face expanding toward the top end is provided. On the other lateral face 21*b* of the housing 21, a connection recess section (connection section) 23*b* having a trapezoid lateral face expanding toward the inside so as to tight fit with the connection protruding section 23*a* is formed. The connection protruding section 23*a* and the connection recess section 23*b* can fit with each other by sliding two development cartridges 20 along each other in longitudinal direction, and once these sections fit, the two development cartridges 20 are not detached in circumferential direction.

On the vertex angle portions on the both end faces 21*a* of the housing 21, part 19*a* of the rotation spindle 19, which constitutes a column-shaped rotation spindle 19 when four development cartridges 20 are connected and combined, is provided in a protruding manner. On one end face 21*a* of the housing 21, a plate-like development position detection piece (development position detection section) 25 is provided in a standing posture. A sensor S such as photointerrupters is mounted on the main body of the color image formation apparatus 10 so that the development position detection piece 25 is detected on a straight line L connecting the rotation center of the photoreceptor 12 and the center 19*b* of the rotation spindle 19 when the development device 18 is rotated around the rotation spindle 19. Thus, by detecting the development position detection piece 25 by a sensor S on the straight line L connecting the rotation center of the photoreceptor 12 and the center 19*b* of the rotation spindle 19, it can be accurately detected that the development cartridge 20 reaches the development position.

Figure 3:
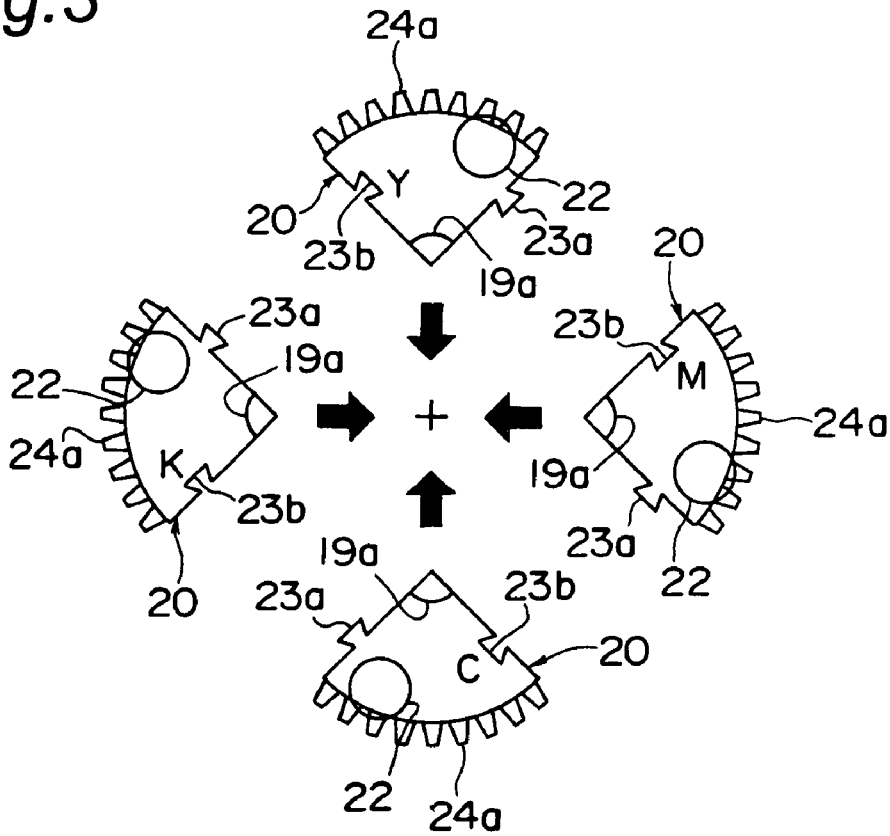
FIG. 3 is a view showing four development cartridges before being connected.

The thus-structured four development cartridges 20 are directly connected by fitting the connection protruding section 23*a* with the connection recess section 23*b* as shown in FIG. 3, by which the almost column-like development device 18 is constituted. Therefore, the development device 18 can be constituted by connecting the development cartridges 20 with each other without special members interposed therebetween, which eliminates the use of conventional development rack and retention members.

Moreover, in the development device 18, the segment gears 24*a* provided on the respective development cartridges 20 are linked to constitute a series of all around gears 24, and part 19*a* of the rotation spindle 19 provided on the respective development cartridges 20 are combined to constitute a column-shaped rotation spindle 19. This eliminate the necessity of additional provision of a gear for driving the development device and a rotation spindle for supporting rotation of the development device.

Moreover, in the development device 18, rotational drive force is transmitted to the development device 18 by engaging the segment gear 24*a* of the development cartridge 20 at the development position with the drive gear 26, and therefore even when the development device 18 constituted by connecting the four development cartridges 20 has loose linkage parts, it becomes possible to move a specified development cartridge to the development position at high accuracy without being affected by the loose linkage parts.

Thus, according to the development cartridge 20 and the development device 18 in the color image formation apparatus 10 of the present embodiment, drive force is transmitted to a development cartridge 20 through the segment gear 24*a* to move the development cartridge 20, so that the development cartridge 20 can be moved to the development position. This makes it possible to eliminate the use of conventional development rack and retention members also including function as the drive members, thereby achieving reduction in number of components, size and cost of the image formation apparatus. Moreover, the absence of the development rack in the image formation apparatus enhances the maintenance inside the apparatus.

It is to be understood that the present invention is not limited to the above-stated embodiment, and various modifications are acceptable.

Figure 4:
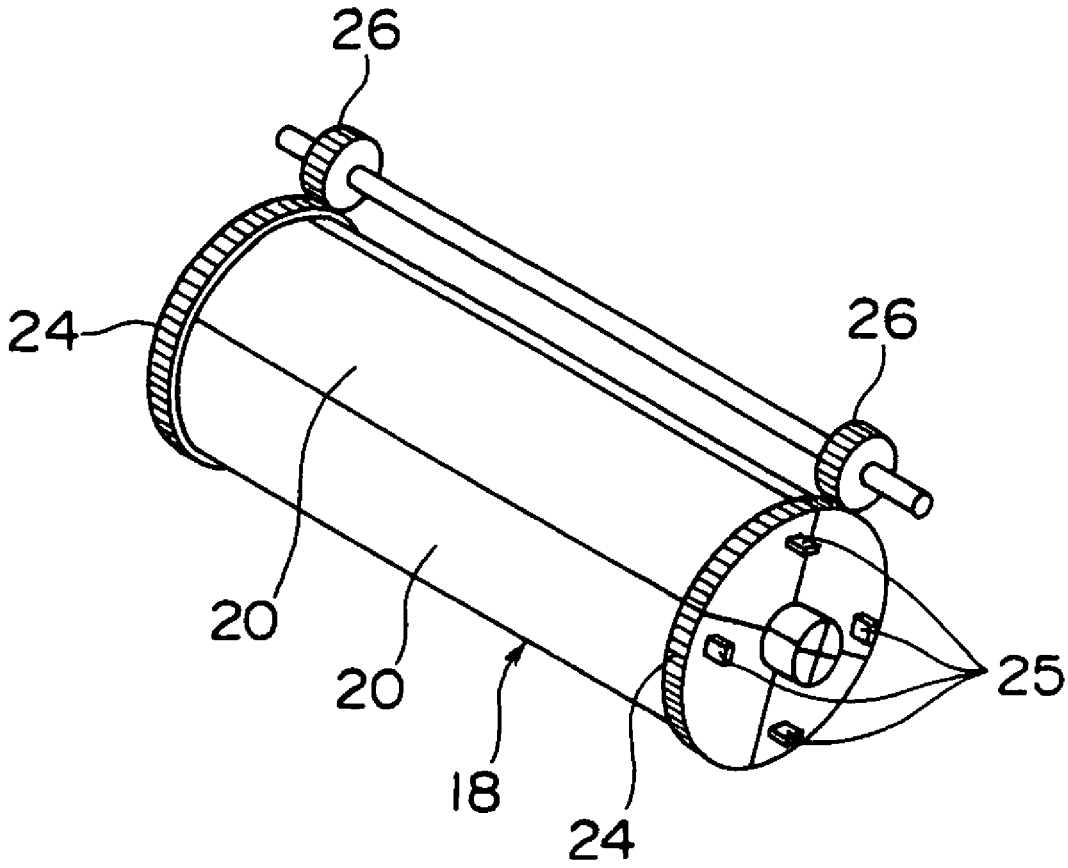
FIG. 4 is a view showing an all-around gear disposed on both ends of a development device.

For example, in the development device 18, a series of the all around gears 24 is provided on one end section in the longitudinal direction. However, as shown in FIG. 4, a series of the all around gears 24 may be provided on both the end sections in longitudinal direction of the development device 18 so that the respective gears 24 are engaged with the drive gear 26. In this case, drive force is transmitted to the development device 18 in a balanced manner through a series of the all around gears 24 on both the ends, which prevents torsion to be generated in the development cartridge 20 by the drive force.

Further, although in the above-stated embodiment, the development device is constituted of four development cartridges 20 corresponding to four color toners, the development device may be constituted by connecting two or three development cartridges corresponding to two color or three color toners, or the development device may be constituted by connecting five or more development cartridges corresponding to five or more color toners.

Figure 5:
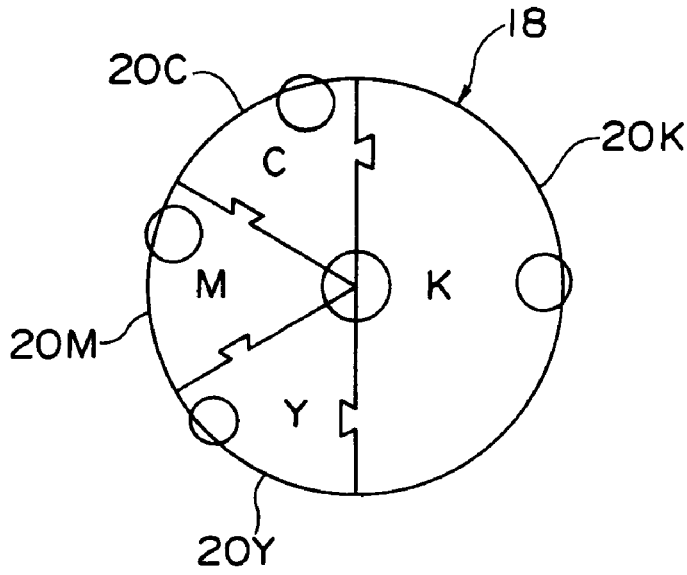
FIG. 5 is a view showing a development device including an enlarged development cartridge for black toner.

Even when the development device 18 is constituted of four development cartridges 20 corresponding to four color toners, it is not necessarily necessary to divide the development device 18 exactly into four sections to form the development cartridges 20 as in the above-stated embodiment. As shown in FIG. 5, a half of a column-shaped development device 18 in circumferential direction may be occupied by a black toner development cartridge 20K, and the remaining half may be divided into three sections, each of which is occupied by a yellow toner development cartridge 20Y, a magenta toner development cartridge 20M and a cyan development cartridge 20C. Thus, increasing the size of the black toner development cartridge 20K larger than other cartridges makes it possible to support a large amount of black-and-white prints.

Figure 6:
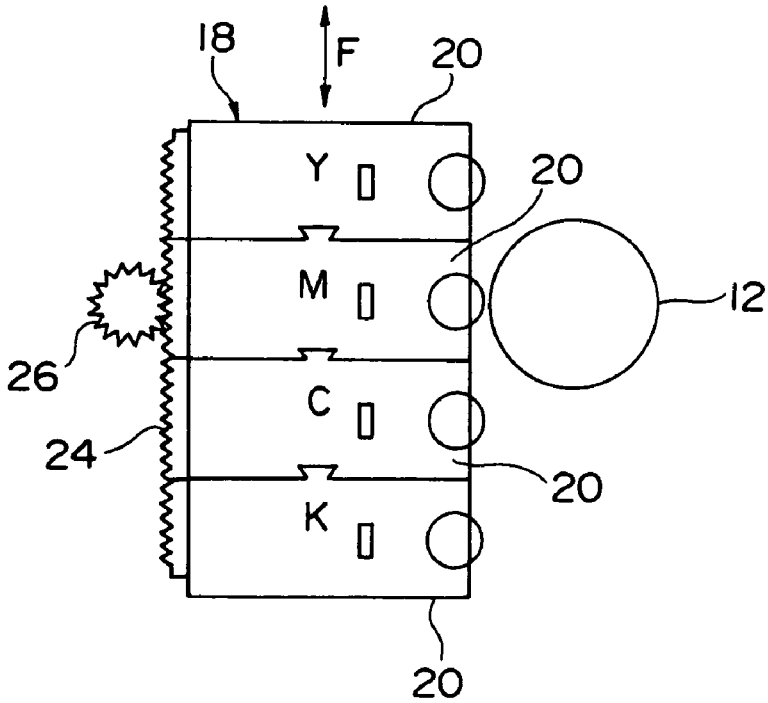
FIG. 6 is a view showing a modified example of a development device constituted of four development cartridges which are connected in the state of being stacked in one direction.
Figure 7:
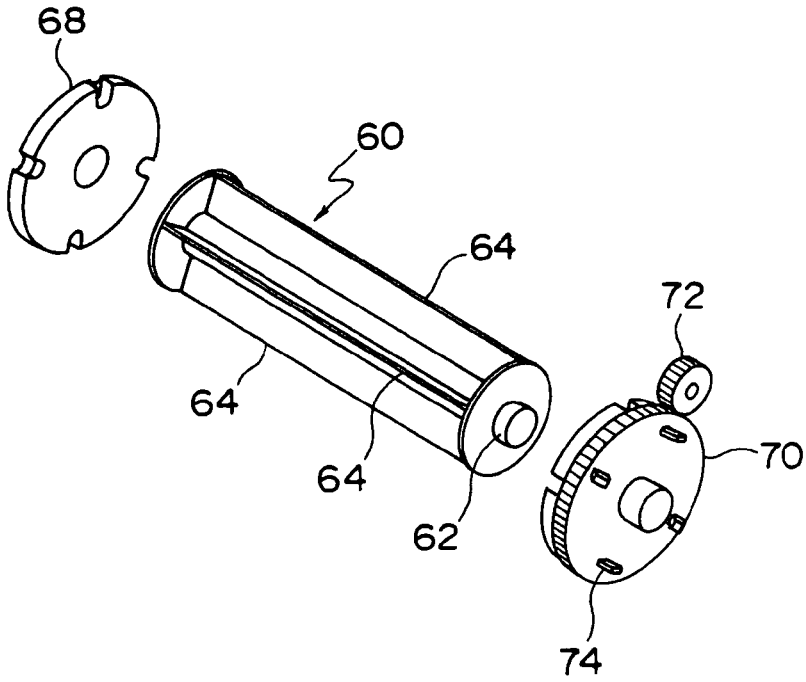
Fig.7 PRIOR ART
FIG. 7 is a view showing a development rack and a retention member for use in a conventional color image formation apparatus.
Figure 8:
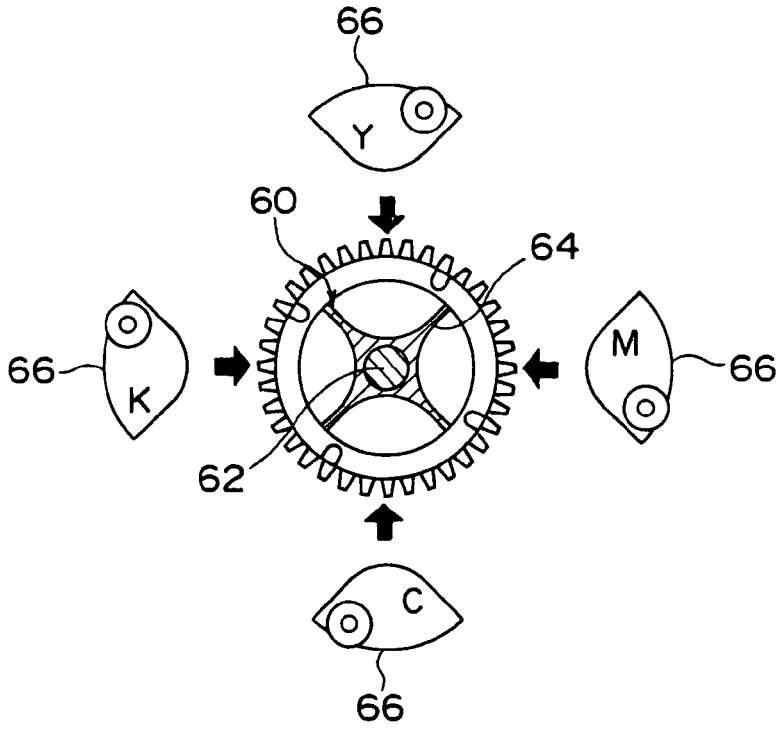
Fig.8 PRIOR ART
FIG. 8 is a view showing the state before four development cartridges are loaded in the development rack.

Further, in the above-stated embodiment, the development device 18 constituted by connecting four development cartridges 20 is rotated to switch development colors. However, as shown in FIG. 6, the development device 18 may be constituted by connecting four development cartridges 20 corresponding to four color toners in the state of being stacked in one direction, and in order to change development colors, the development device 18 is reciprocally moved in an arrow F direction by a drive gear 26 which is engaged with a series of gears 24 linked in a straight line by combining the four development cartridge 20.

It is to be understood that the present invention is applicable to any of copying machines, printing machines, facsimiles and their complex machines as long as they are four-cycle color image formation apparatuses.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A development device comprising a plurality of development cartridges which are assembled to each other to form the development device, wherein each of the development cartridges comprises a part of a drive member for switching development colors, and a rotation spindle;

wherein when each developer cartridge is at a development position where a development roller is in contact with a photoreceptor, said development cartridges are each driven by their own respective part of the drive member for switching development colors;

wherein each of the development cartridges further comprises a connection section for establishing direct connection with other of the development cartridges, and a plurality of the development cartridges are connected through the connection sections so that a part of the drive members are combined to constitute a series of gears; and wherein each of the development cartridges further comprises a part of a rotation spindle, and a plurality of the development cartridges are connected through the connection sections so that a part of the rotation spindles are combined to form a column shape.

2. The development device as defined in claim 1, further comprising a development position detection section.

3. The development device as defined in claim 1, wherein the part of the drive member is integrated with the development device.

4. The development device as defined in claim 1, wherein the part of the drive member is disposed respectively on both ends in longitudinal direction of the development device.

5. A color image formation apparatus comprising a development device which comprises a plurality of development cartridges assembled to each other to form the development device, each of the development cartridges having a part of a drive member for switching development colors, wherein when each developer cartridge is at a development position where a development roller is in contact with a photoreceptor, said development cartridges are each driven by their own respective part of the drive member for switching development colors;

wherein each of the development cartridges further comprises a connection section for establishing direct connection with other of the development cartridges, and a plurality of the development cartridges are connected through the connection sections so that a part of the drive members are combined to constitute a series of gears; and wherein each of the development cartridges further comprises a part of a rotation spindle, and a plurality of the development cartridges are connected through the connection sections so that a part of the rotation spindles are combined to form a column shape.

6. The color image formation apparatus as defined in claim 5, wherein the development device further comprises a development position detection section, and it is detected by the development position detection section of the development device at the development position that the development device is at the development position where the development roller is in contact with the photoreceptor.

7. The color image formation apparatus as defined in claim 5, wherein position of the development position detection section is detected on a straight line connecting a rotation center of the photoreceptor and a center of the rotation spindle.

8. A development device comprising a plurality of development cartridges, each having a male connection section that is for connecting with a female connection section on an adjacent development cartridge, the development cartridges being integrated by direct connection through the male and female connection sections;

when each developer cartridge is at a development position where a development roller is in contact with a photoreceptor, said development cartridges are each driven by their own respective part of the drive member for switching development colors;

wherein each of the development cartridges further comprises a connection section for establishing direct connection with other of the development cartridges, and a plurality of the development cartridges are connected through the connection sections so that a part of the drive members are combined to constitute a series of gears; and wherein each of the development cartridges further comprises a part of a rotational spindle, and a plurality of the development cartridges are connected and integrated so that a part of the rotation spindles are combined to form a column shape.

9. The development device as defined in claim 8, wherein a series of the gears that is the drive member is disposed respectively on both ends in longitudinal direction of the development device.

10. The development device as defined in claim 8, which is driven via a part of the drive member of the development cartridge positioned at a development position facing a photoreceptor.

11. The development device as defined in claim 8, wherein each of the plurality of the development cartridges has a development position detection section, and it is detected by the development position detection section of the development cartridge at the development position that a specified development cartridge is at the development position where a development roller is in contact with a photoreceptor.

12. A development cartridge comprising an accommodating section containing developer and a development roller feeding the developer contained in the accommodating section for development, a part of a series of gears being a drive member for switching development colors, a connection section for establishing direct connection to other development cartridges; and a part of a rotation spindle, wherein combining a plurality of the development cartridges with each other achieves a complete formation of the drive member;

wherein the gears are formed in series along the periphery of the plurality of the development cartridges when the plurality of development cartridges are connected through the connection sections, and wherein the part of the rotation spindles is combined to form a column shape when the plurality of the development cartridges are connected through the connection sections.

13. The development cartridge as defined in claim 12, further comprising a development position detection section.

14. The development cartridge as defined in claim 12, wherein the part of the drive member is integrated with the development cartridge.

15. The development cartridge as defined in claim 12, wherein the part of the drive member is disposed respectively on both ends in longitudinal direction of the development cartridge.

* * * * *